US005836128A

United States Patent [19]

Groh et al.

[11] Patent Number: 5,836,128

[45] Date of Patent: Nov. 17, 1998

[54] DECK PLANK

[75] Inventors: A. Anthony Groh, Columbus; Philip H. Stobart, Worthington, both of Ohio

[73] Assignee: Crane Plastics Company Limited Partnership, Columbus, Ohio

[21] Appl. No.: 752,813

[22] Filed: Nov. 21, 1996

[51] Int. Cl.[6] ..... E04C 3/00

[52] U.S. Cl. ..... 52/580; 52/314; 52/578; 52/650.3; 52/745.05; 52/775

[58] Field of Search ..... 52/309.1, 314, 52/483.1, 578, 580, 581, 604, 605, 745.05, 745.06, 745.13, 747.1, 764, 765, 775, 780, 650.3

[56] References Cited

U.S. PATENT DOCUMENTS

| | | | |
|---|---|---|---|
| 502,289 | 8/1893 | Feldmann | 52/578 |
| 1,374,082 | 1/1921 | Hedges | 52/578 |
| 1,551,544 | 9/1925 | Crooks | 52/578 |
| 1,952,536 | 3/1934 | Crooks | 52/578 |
| 2,947,040 | 8/1960 | Schultz | 52/578 X |
| 3,386,221 | 6/1968 | Giovannucci | 52/578 |
| 4,241,133 | 12/1980 | Lund et al. . | |
| 4,376,144 | 3/1983 | Goettler . | |
| 5,033,147 | 7/1991 | Svensson | 52/483.1 X |
| 5,410,855 | 5/1995 | Clausen et al. | 52/747.1 |
| 5,411,782 | 5/1995 | Jarvis et al. | 52/580 X |
| 5,516,472 | 5/1996 | Laver | 264/118 |

FOREIGN PATENT DOCUMENTS

| | | |
|---|---|---|
| 93306843 | 8/1993 | European Pat. Off. . |
| 93306845 | 8/1993 | European Pat. Off. . |

*Primary Examiner*—Carl D. Friedman
*Assistant Examiner*—Kevin D. Wilkens
*Attorney, Agent, or Firm*—Standley & Gilcrest

[57] ABSTRACT

A tongue and groove deck plank made from a wood replacement material. The deck plank is substantially hollow, and generally rectangular. It has a horizontal top and bottom, a tongue on one edge, and a groove on the other. When the tongue of one deck plank and the groove of another are placed next to one another, a space is maintained between a portion of the tongue and a portion of the groove. A deck may be made from the deck planks. The deck has a support, and at least one wood replacement deck plank attached to the support. The deck preferably includes a starter strip attached to the support.

55 Claims, 10 Drawing Sheets

DECK PLANK

BACKGROUND OF THE INVENTION

The present invention relates generally to decks and more particularly to a deck plank having a tongue and a groove.

Wood is commonly used for decks. However, the use of wood for decks presents a number of problems. First, constant exposure to the elements can cause the wood to deteriorate over time. In order to prevent (or delay) this from happening, the wood must be treated with a wood preservative. Treating the wood can be a time consuming and messy process. Next, wood is frequently stained or painted to achieve a desired color, but the color can fade or chip and peel over time.

In addition, the dimensions of wood vary depending on the moisture content of the wood and the temperature. These variations can cause warping of the boards which can cause the surface of the deck to become uneven over time. Finally, when a tongue and groove arrangement of boards is used, if the head of the nail is not flush with the surface of the board, the next board will not fit against it properly, resulting in an uneven surface.

Therefore, it would be desirable to have an improved tongue and groove joint. It would also be desirable to have a deck plank having improved dimensional stability and decreased maintenance. The deck plank should be easy to install. The design of the deck plank should ensure that the deck will be smooth and even when installed.

DESCRIPTION OF THE INVENTION

Figure 1:
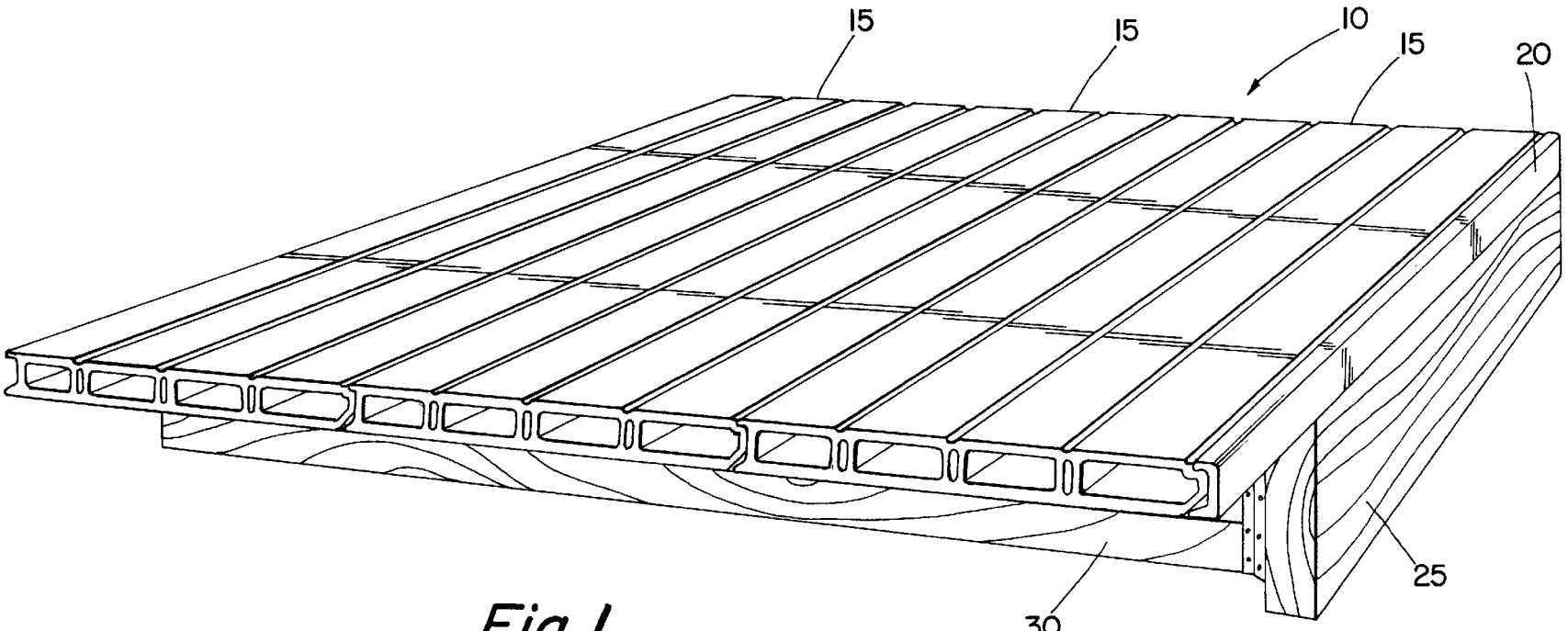
FIG. 1 is a perspective view of one embodiment of a deck of the present invention.

The invention involves a deck plank made from a wood replacement material. The deck plank is substantially hollow, and generally rectangular. It has a horizontal top and bottom, a first edge attached to the top and bottom forming a tongue, and a second edge opposite the first edge and attached to the top and bottom forming a groove, the tongue being adapted to fit with the groove of an adjacent plank.

The tongue and groove of the deck plank are preferably shaped so that a space is maintained between a portion of the tongue of one plank and a portion of the groove of the adjacent plank when the tongue is placed adjacent to the groove of the adjacent plank. The particular shape of the tongue and groove is not important. Many different shapes could be used, including curves and various complex shapes.

Preferably, the tongue has a substantially vertical portion and an angled portion of a first angle and the groove has a substantially vertical portion and an angled portion of a second angle, the first angle being sufficiently different from the second angle so that a space is maintained between the angled portion of the tongue and the angled portion of the groove of the adjacent plank when the substantially vertical portion of the tongue is placed adjacent to the substantially vertical portion of the groove of the adjacent plank. The first angle can either be greater than or less than the second angle.

Preferably, the tongue of the deck plank has an upper portion above the substantially vertical portion and the groove has an upper portion above the substantially vertical portion, the upper portion of the tongue and the upper portion of the groove being so shaped that a gap is maintained between the upper portion of the tongue and the upper portion of the groove of the adjacent plank when the substantially vertical portion of the tongue is placed adjacent to the substantially vertical portion of the groove of the adjacent plank.

The deck plank preferably has at least one vertical support extending from the bottom of the plank to the top at a point intermediate between the first and second edges. There is preferably at least one notch in the top of the plank extending the length of the plank.

The invention also involves a deck made from the deck planks. The deck has a support, and at least one deck plank attached to the support. The deck preferably includes a starter strip attached to the support having a first edge forming a groove adapted to receive the tongue of the deck plank.

The tongue of the deck plank and the groove of the starter strip are preferably shaped so that a space is maintained between a portion of the groove of the starter strip and a portion of the tongue of the deck plank when the tongue of the deck plank is placed adjacent to the groove of the starter strip.

Preferably, the groove of the starter strip has a substantially vertical portion and an angled portion of a third angle, the groove of the starter strip being adapted to receive the tongue of the deck plank which has a substantially vertical portion and an angled portion of a first angle, the first angle of the tongue of the deck plank being sufficiently different from the third angle of the groove of the starter strip so that a space is maintained between the angled portion of the tongue of the deck plank and the angled portion of the groove of the starter strip when the substantially vertical portion of the tongue of the deck plank is placed adjacent to the substantially vertical portion of the groove of the starter strip.

The invention also involves a deck plank having a tongue and a groove. The tongue has a substantially vertical portion and an angled portion of a first angle and the groove has a substantially vertical portion and an angled portion of a second angle, the first angle being sufficiently different from the second angle so that a space is maintained between the angled portion of the tongue and the angled portion of the groove of the adjacent plank when the substantially vertical portion of the tongue is placed adjacent to the substantially vertical portion of the groove of the adjacent plank. The substantially vertical portion of the tongue preferably has a horizontal slot in it.

The deck plank of the present invention may either be made from wood, plastics or from several other materials including wood replacement material. The wood replacement material may be a polymer, such as homopolymers and copolymers of polyethylene or polyvinyl chloride, or a mixture of these polymers. The wood replacement material preferably includes cellulose material to make it look more like real wood. The cellulose material can be in the form of cellulose fibers (e.g., wood flour and the like). A suitable wood replacement material composition and method are described in U.S. Pat. No. 5,516,472 entitled EXTRUDED SYNTHETIC WOOD COMPOSITION AND METHOD FOR MAKING SAME, which is hereby incorporated by reference herein. The deck planks made from wood replacement materials are preferably extruded, using conventional extrusion equipment and one or more dies to provide the desired cross section shape of each plank.

The invention also involves a method of making a deck including providing a support, providing a first deck plank made from a wood replacement material, the deck plank being substantially hollow and generally rectangular and having a horizontal top and bottom, a first edge attached to the top and bottom forming a tongue, and a second edge opposite the first edge and attached to the top and bottom forming a groove, the tongue adapted to fit with a groove of an adjacent plank, and attaching the first deck plank to the support. A starter strip having a first edge forming a groove adapted to receive the tongue of the first deck plank may be attached to the support, the tongue of the first deck plank being placed adjacent the groove of the starter strip. Additional deck planks may be added. The deck planks and starter strip are preferably attached to the support though angled portions of the respective grooves.

FIG. 1 generally shows one embodiment of a deck 10 according to the present invention. The deck 10 is composed of a series of deck planks 15 and a starter strip 20. The deck is supported by a ledger 25 and joists 30 (only one shown) perpendicular to the ledger.

Figure 2:
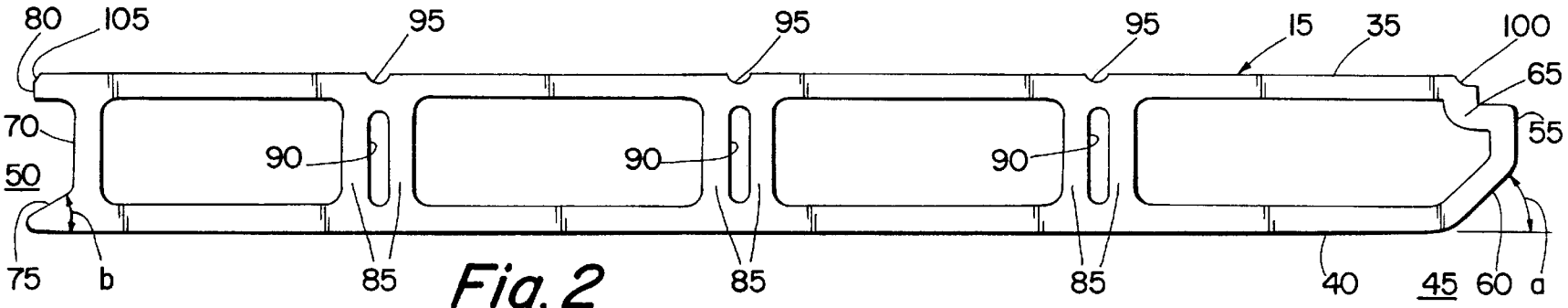
FIG. 2 is a cross-section of one embodiment of a deck plank of the present invention.

The deck plank 15 is shown in more detail in FIG. 2. The deck plank 15 has a horizontal top 35 and bottom 40. The deck plank is approximately 1.25 inches thick. The top and bottom of the deck plank are approximately 0.20 inches thick. The deck plank can be made in a variety of standard lengths, e.g. 8, 10, and 12 foot lengths. The weight of the deck plank 15 is greatly reduced as compared to a either a wood plank or a solid plank made from a wood replacement material because it is substantially hollow.

One edge of the deck plank has a tongue 45 and the opposite edge has a groove 50. The tongue has a substantially vertical portion 55, an angled portion 60, and an upper portion 65. The angled portion 60 extends from the bottom 40 to the substantially vertical portion 55. The angle a of the angled portion 60 is measured relative to the bottom of the deck plank. In this embodiment, the angle is preferably approximately 45°. The substantially vertical portion 55 extends substantially vertically upward from the end of the angled portion 60 to the upper portion 65.

The groove 50 has a substantially vertical portion 70, an angled portion 75, and an upper portion 80. The angled portion 75 extends from the bottom 40 to the substantially vertical portion 70. The angle b of the angled portion 75 is measured relative to the bottom of the deck plank. In this embodiment, the angle b of the groove is less than the angle a of the tongue, and preferably is approximately 29°. The substantially vertical portion 70 extends substantially vertically upward from the end of the angled portion 75 to the upper portion 80.

Figure 24:
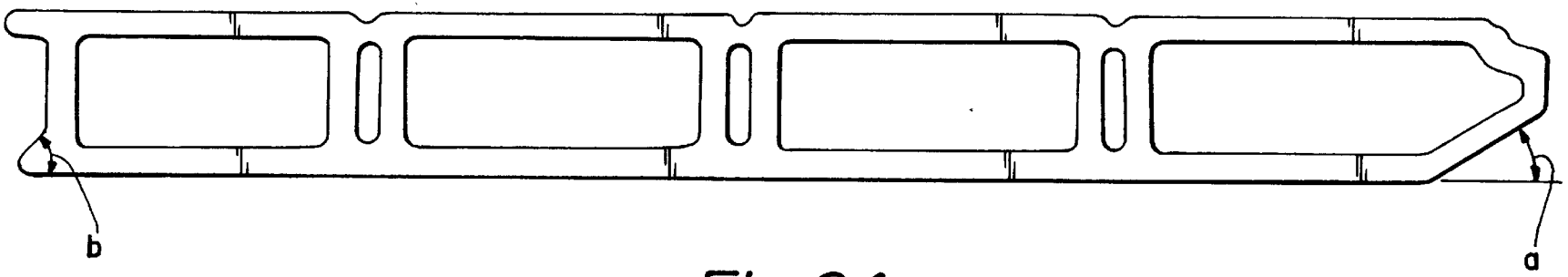
FIG. 24 is a cross-section of another alternate embodiment of a deck plank in which the second angle is greater than the first angle.

In an alternate embodiment of the deck plank, the angle b of the groove may be greater than the angle a of the tongue. FIG. 24 illustrates an alternate embodiment of a deck plank in which the angle b of the groove is greater than the angle a of the tongue.

The deck plank 15 preferably has three pairs of vertical supports 85. The vertical supports 85 extend from the bottom 40 to the top 35 of the deck plank. There is an opening 90 between each pair of vertical supports 85. The vertical supports 85 provide support for the top 35 of the deck plank. Each pair of vertical supports 85 flanks a notch 95 in the top 35 which extends the length of the deck plank. The notches 95 are above the openings 90.

A partial notch 100 is formed in the upper portion 65 of the tongue 45. The partial notch 100 is preferably more than one half of a complete notch. The upper portion 80 of the groove 50 has a complementary portion 105 of a notch. When two deck planks are put together, the partial notch 100 of one deck plank 15 is mated with the complementary portion 105 of the second plank to form a complete notch.

The deck planks can be made in different widths, e.g. 6 inch and 12 inch widths, and can have different numbers of notches. The notches in the top provide the deck plank with the look of a series of smaller boards. For instance, if the deck plank is approximately 12 inches in width and it has three notches, it appears to be four boards of about 3 inches each. A 6 inch deck plank with one notch would appear to be two 3 inch boards. However, rather than having to nail four boards per foot of decking, the 12 inch deck plank requires only one nail per foot, while the 6 inch deck plank would require only two.

Figure 3:
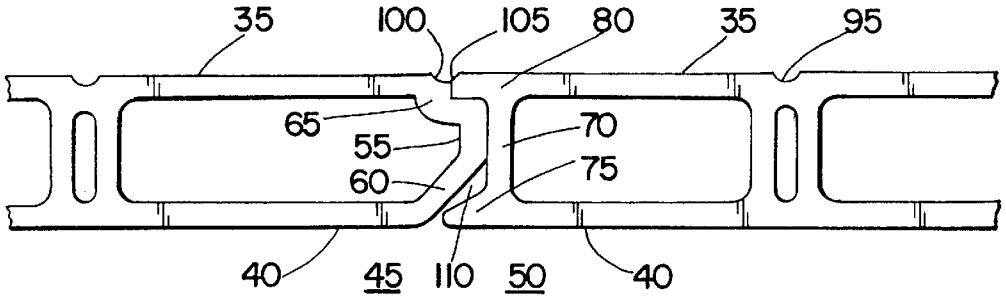
FIG. 3 is a partial view showing a cross-section of a tongue and groove joint between deck planks of one embodiment of the present invention.

FIG. 3 shows a joint between two deck planks 15. The tongue 45 of one deck plank is mated with the groove 50 of an adjacent plank. The substantially vertical portion 55 of the tongue is positioned adjacent to the substantially vertical portion 70 of the groove. The upper portion 80 of the groove is adjacent to the upper portion 65 of the tongue. The partial notch 100 of the upper portion 65 of the tongue and the complementary portion 105 of the upper portion 80 of the groove form a complete notch. A space 110 is maintained between the angled portion 60 of the tongue and the angled portion 75 of the groove due to the difference between the angles a and b.

Figure 4:
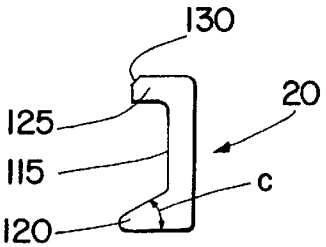
FIG. 4 is a cross-section of one embodiment of a starter strip of the present invention.
Figure 6:
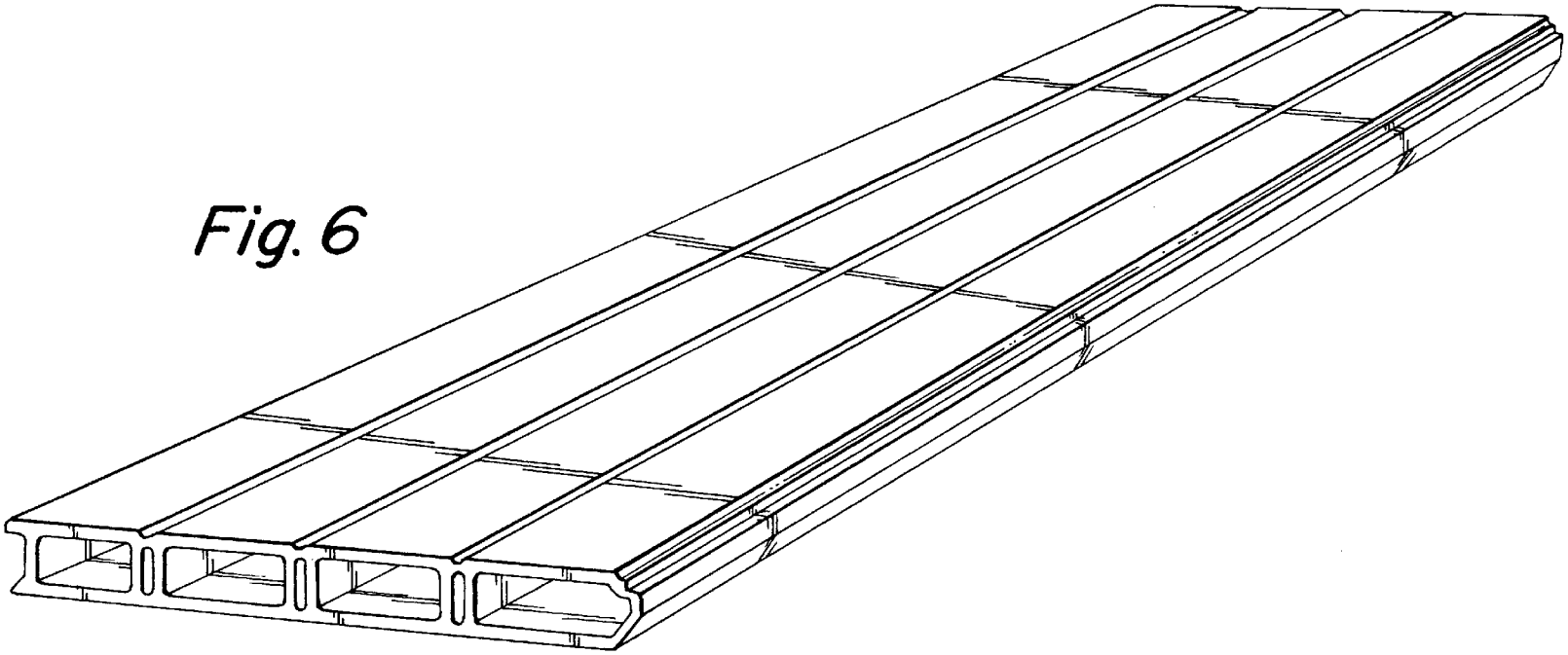
FIG. 6 is a perspective view of the deck plank of FIG. 2.
Figure 7:
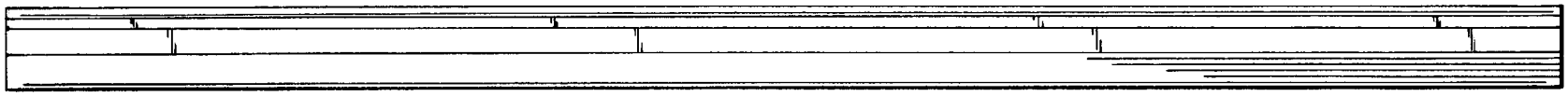
FIG. 7 is a right side view of the deck plank of FIG. 2.
Figure 8:
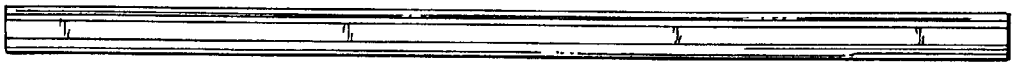
FIG. 8 is a left side view of the deck plank of FIG. 2.
Figure 9:
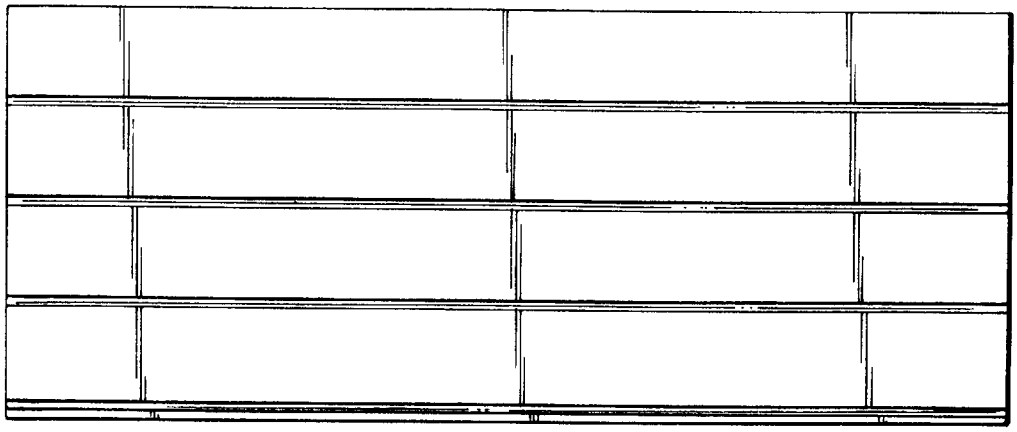
FIG. 9 is top plan view of the deck plank of FIG. 2.
Figure 10:
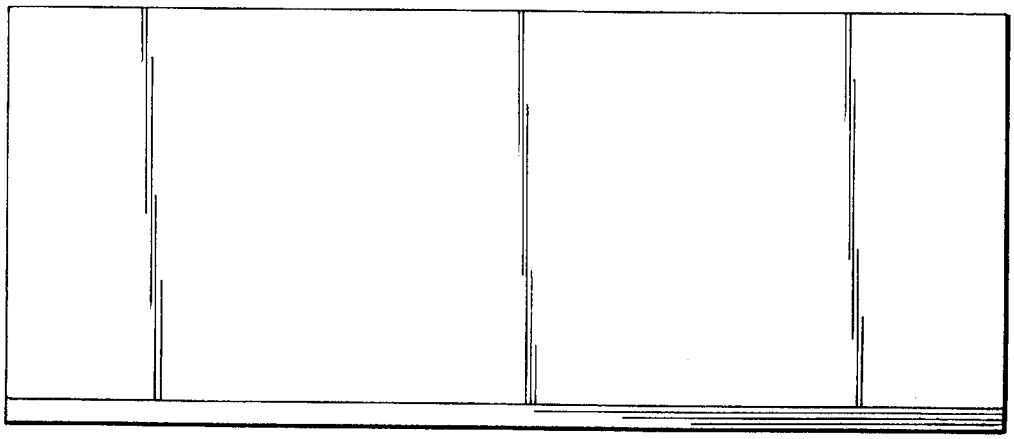
FIG. 10 is a bottom view of the deck plank of FIG. 2.
Figure 11:
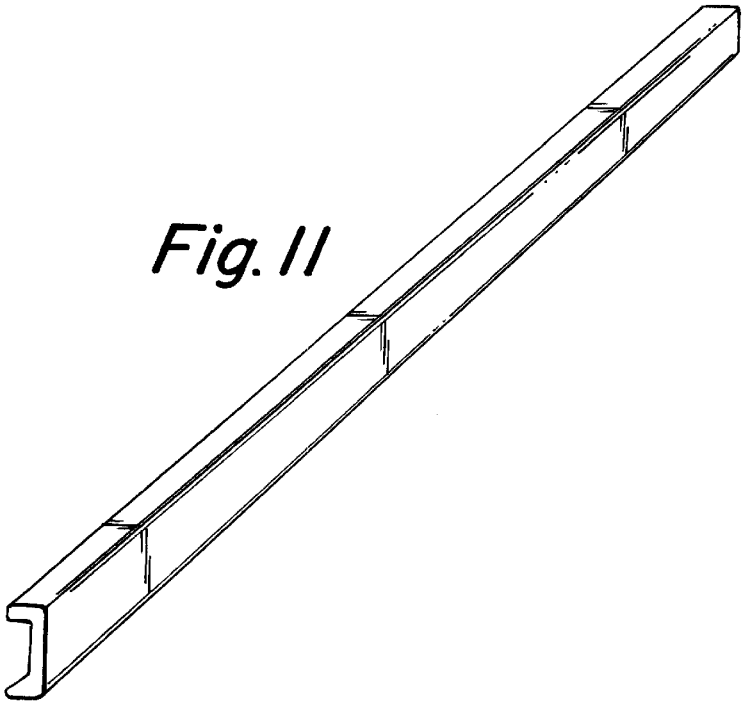
FIG. 11 is a perspective view of the starter strip of FIG. 4.
Figure 12:
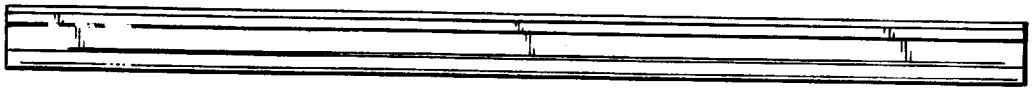
FIG. 12 is a left side view of the starter strip of FIG. 4.
Figure 13:
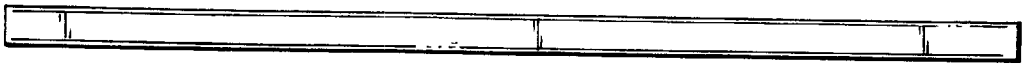
FIG. 13 is a top plan view of the starter strip of FIG. 4.
Figure 14:
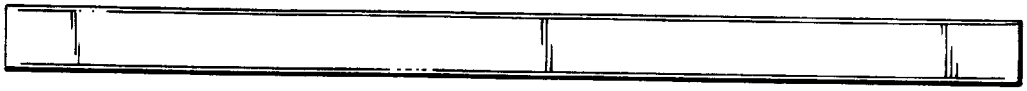
FIG. 14 is a right side view of the starter strip of FIG. 4.
Figure 15:
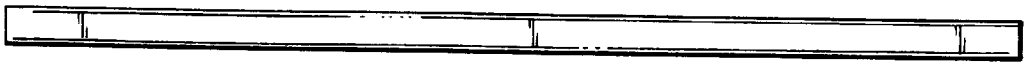
FIG. 15 is a bottom view of the starter strip of FIG. 4.

The starter strip 20 is shown in FIG. 4. The starter strip 20 has a substantially vertical portion 115, an angled portion 120, and an upper portion 125. The upper portion 125 has a complementary portion 130 of a notch. The angle c of the angled portion 120 is measured relative to the bottom of the deck plank. In this embodiment, the angle c is less than angle a, and it is preferably the same as angle b.

Figure 25:
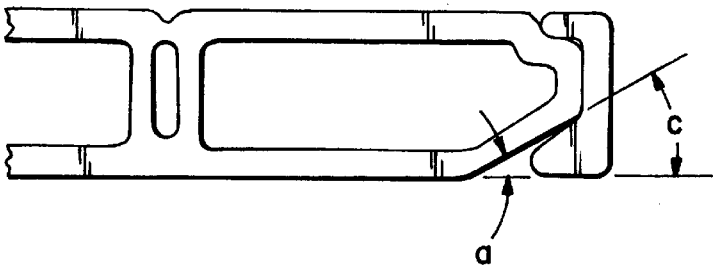
FIG. 25 is a partial view showing a cross-section of a tongue and groove joint between a deck plank and a starter strip of an alternate embodiment of the present invention in which the third angle is greater than the first angle.

In an alternate embodiment of the present invention, the angle c of a starter strip may be greater than the angle a of a deck plank. FIG. 25 illustrates a tongue and groove joint between a deck plank and a starter strip of an alternate embodiment of the present invention in which the angle c of the starter strip is greater than the angle a of the deck plank.

Figure 5:
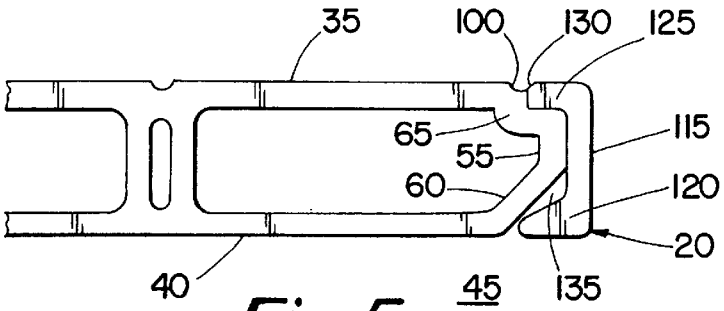
FIG. 5 is a partial view showing a cross-section of a tongue and groove joint between a deck plank and a starter strip of one embodiment of the present invention.

The joint between a starter strip 20 and a deck plank 15 is shown in FIG. 5. The tongue 45 of the deck plank is mated with the starter strip 20. The substantially vertical portion 55 of the tongue is positioned adjacent to the substantially vertical portion 115 of the starter strip. The upper portion 125 of the starter strip is adjacent to the upper portion 65 of the tongue. The partial notch 100 of the upper portion 65 of the groove and the complementary portion 130 of the upper portion 125 of the starter strip form a complete notch. A space 135 is maintained between the angled portion 60 of the tongue and the angled portion 120 of the starter strip due to the difference between the angles a and c.

FIGS. 6–10 show one embodiment of the deck plank of the present invention. FIGS. 11–15 show views of the corresponding starter strip.

Figure 16:
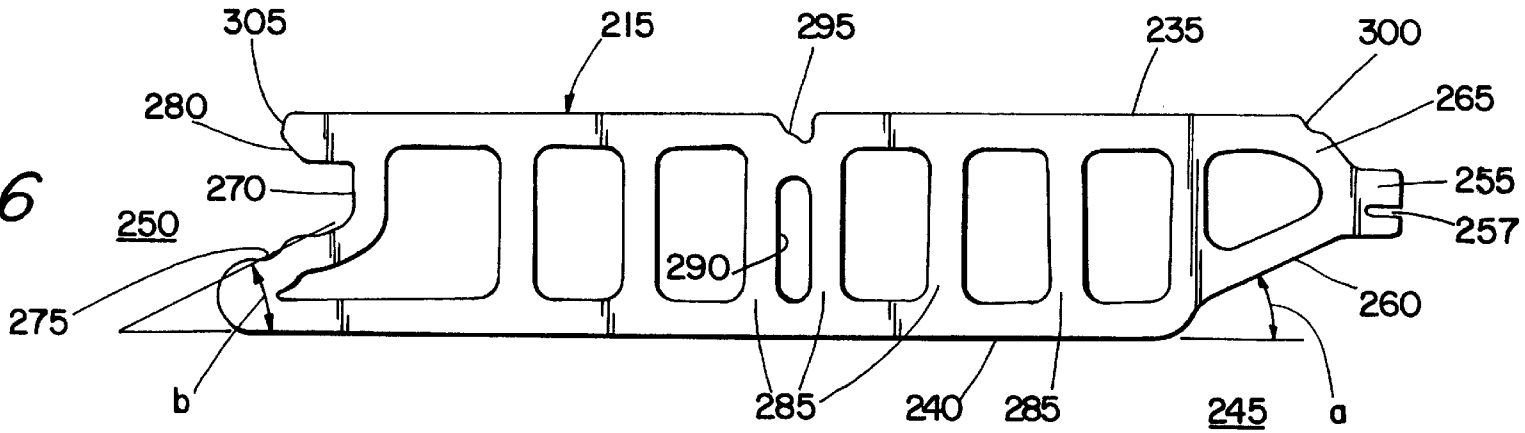
FIG. 16 is a cross-section of a deck plank.

An alternate embodiment of the deck plank and starter strip are shown in FIGS. 16–23. The deck plank 215 is shown in FIG. 16. The deck plank 215 has a horizontal top 235 and bottom 240. One edge of the deck plank has a tongue 245 and the opposite edge has a groove 250. The tongue has a substantially vertical portion 255, an angled portion 260, and an upper portion 265. The angled portion 260 extends from the bottom 240 to the substantially vertical portion 255. The angle a of the angled portion 260 is measured relative to the bottom of the deck plank. The substantially vertical portion 255 extends outward from the angled portion 260 and the upper portion 265.

The substantially vertical portion 255 has a horizontal slot 257. The horizontal slot 257 allows for expansion and contraction in the deck plank. If the planks expand, they can move horizontally. The horizontal slot 257 allows the part of the substantially vertical portion 255 below the horizontal slot 257 to compress upward while maintaining a tight fit between the upper edge of the substantially vertical portion 255 and the bottom of the upper portion of the groove of the adjacent plank.

The groove 250 has a substantially vertical portion 270, an angled portion 275, and an upper portion 280. The angled portion 275 extends from the bottom 240 to the substantially vertical portion 270. The angle b of the angled portion 275 is measured relative to the bottom of the deck plank. The substantially vertical portion 270 extends substantially vertically upward from the angled portion 275 to the upper portion 280.

The deck plank 215 preferably has vertical supports 285. The vertical supports 285 extend from the bottom 240 to the top 235 of the deck plank. A pair of vertical supports 285 flanks a notch 295 in the top 235 which extends the length of the deck plank. The notch 295 is above an opening 290.

A partial notch 300 is formed in the upper portion 265 of the tongue 245. The partial notch 300 is preferably more than one half of a complete notch. The upper portion 280 of the groove 250 has a complementary portion 305 of a notch. When two deck planks are put together, the partial notch 300 of one deck plank 215 is mated with the complementary portion 305 of the second plank to form a complete notch.

Figure 17:
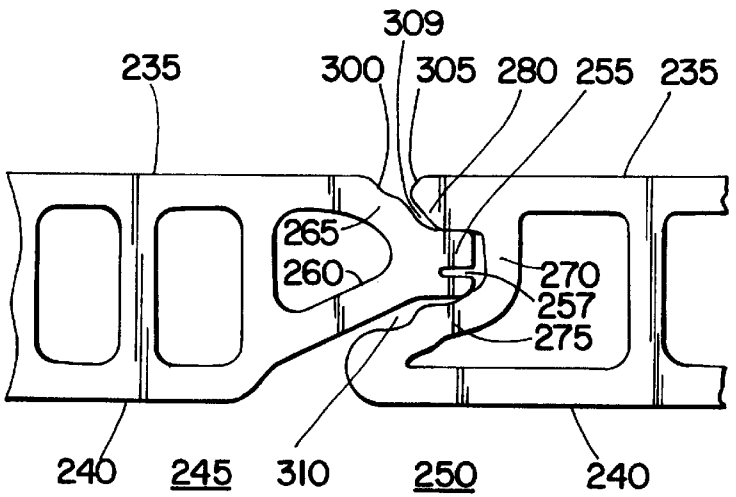
FIG. 17 is a partial view showing a cross-section of a tongue and groove joint between deck planks of an alternate embodiment of the present invention.
Figure 19:
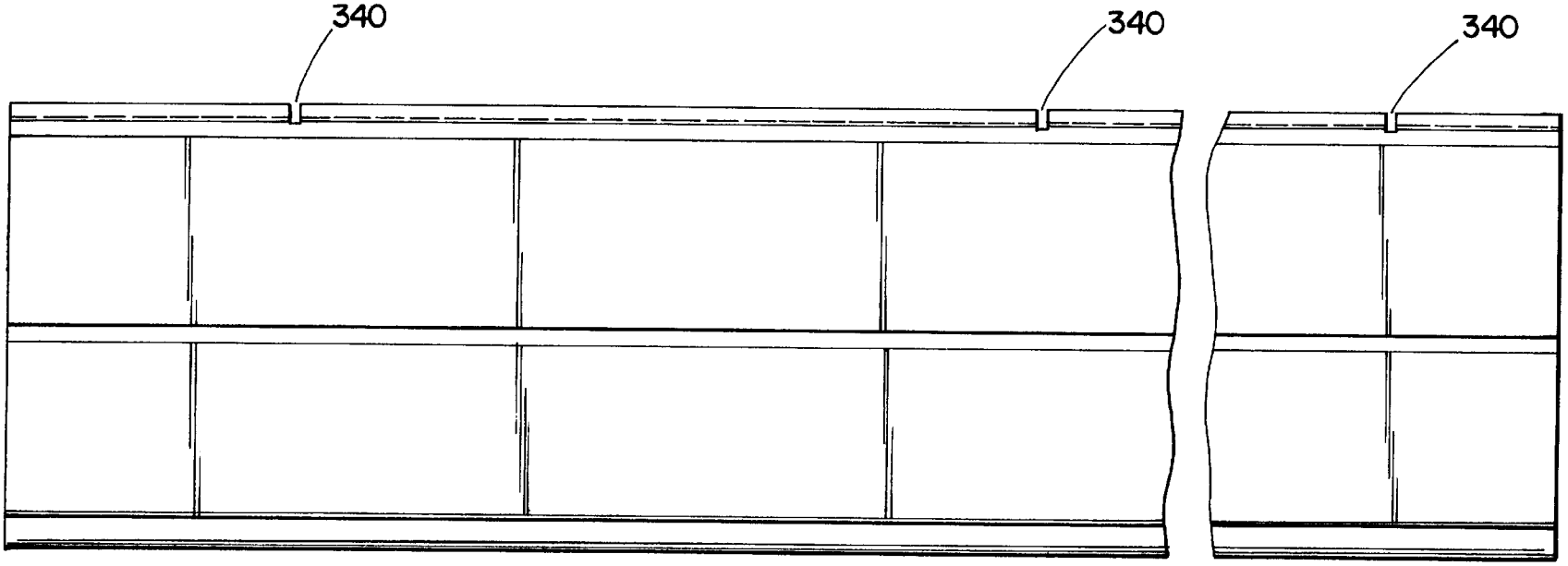
FIG. 19 is a top view of the deck plank of FIG. 16.
Figure 20:
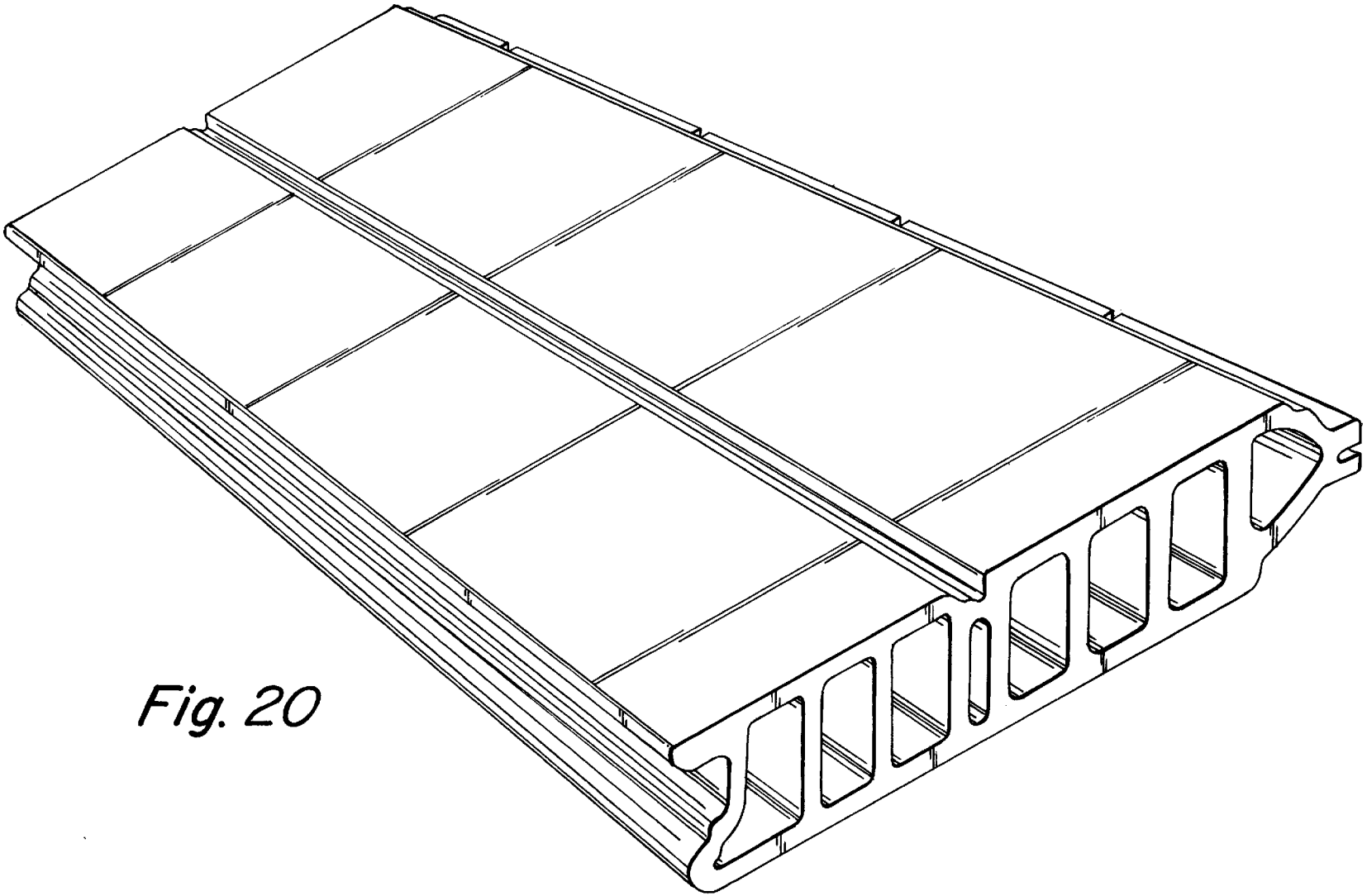
FIG. 20 is a perspective view of the deck plank of FIG. 16.
Figure 21:
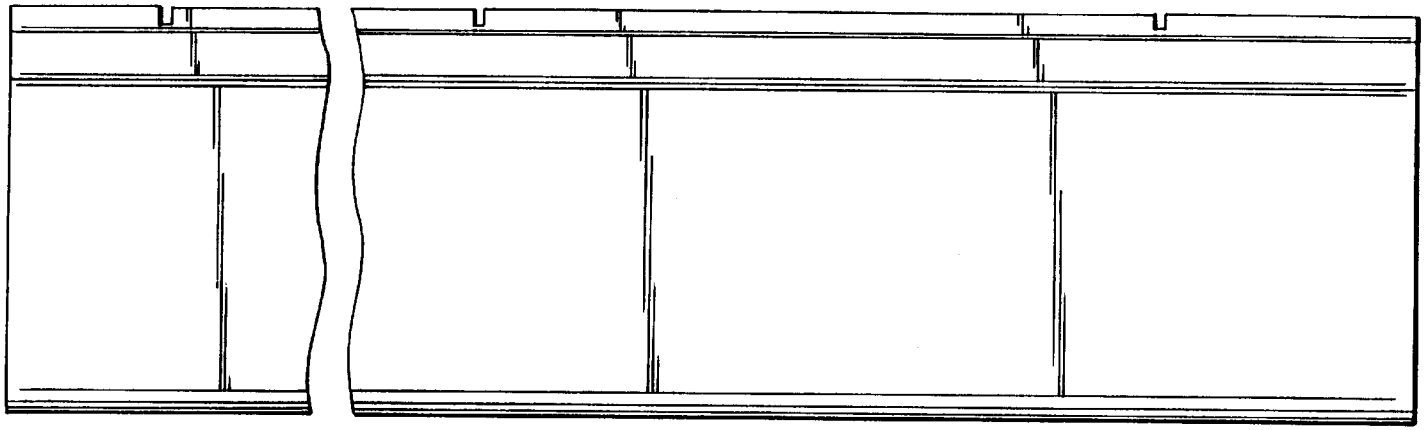
FIG. 21 is a bottom view of the deck plank of FIG. 16.
Figure 22:
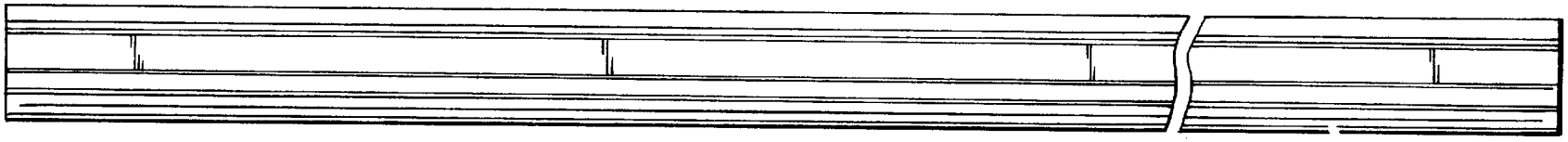
FIG. 22 is a left side view of the deck plank of FIG. 16.
Figure 23:
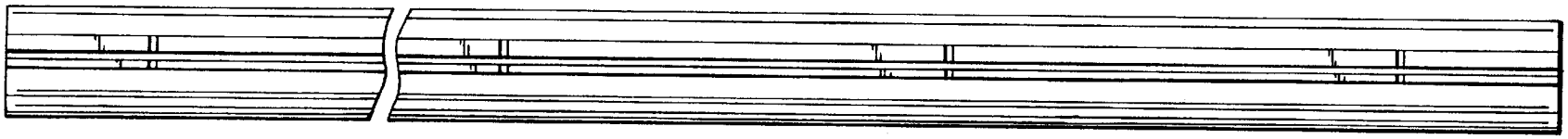
FIG. 23 is a right side view of the deck plank of FIG. 16.

FIG. 17 shows a joint between two deck planks. The tongue 245 of one deck plank is mated with the groove 250 of an adjacent plank. The substantially vertical portion 255 of the tongue is positioned adjacent to the substantially vertical portion 270 of the groove. The upper portion 280 of the groove is adjacent to the upper portion 265 of the tongue. The partial notch 300 of the upper portion 265 of the tongue and the complementary portion 305 of the upper portion 280 of the groove form a complete notch.

There is a gap between the upper portion 265 of the tongue and the upper portion 280 of the groove of the adjacent plank below the partial notch 300 and the complementary portion 305. Water which flows into the notch continues downward into the gap 309. From there, the water flows horizontally along the gap 309 to vertical slits in the tongue of the plank (not shown in FIG. 17). The water then flows down through the vertical slits and out the bottom of the plank through the space 310. The space 310 is maintained between the angled portion 260 of the tongue and the angled portion 275 of the groove due to the difference between the angles a and b.

Figure 18:
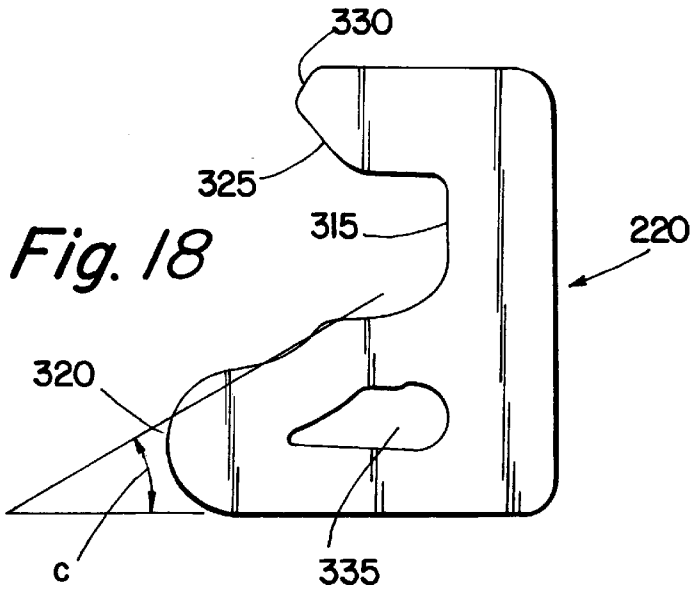
FIG. 18 is a cross-section of an alternate embodiment of a starter strip.

The starter strip 220 is shown in FIG. 18. The starter strip 220 has a substantially vertical portion 315, an angled portion 320, and an upper portion 325. The upper portion 325 has a complementary portion 330 of a notch. The angle c of the angled portion 320 is measured relative to the bottom of the deck plank. In this embodiment, the angle c is less than angle a, and it is preferably the same as angle b. There is an opening 335 in the starter strip 220.

FIGS. 19–23 show a various view of the deck plank. The deck plank has a series of vertical slits 340 in the tongue. The vertical slits 340 extend through the substantially vertical portion of the tongue. The vertical slits 340 can be placed at different points along the length of the plank, for example, every twelve inches. Water which flows into the joint between the tongue of one plank and the groove of the next can flow downward through the vertical slits 340 and out through the angled portions on the bottom of the plank. The combination of the gap 309, the vertical slits 340, and the space 310, which allows water to flow downward through the joints between the deck planks, helps reduce the buildup of water on the surface of the deck which could create a slipping hazard.

The method of making the deck of the present invention can described with regard to the first embodiment. The starter strip 20 is nailed, screwed, stapled or otherwise attached to the ledger 25 at intervals along its length. The nails (or other attachments) extend through the angled portion 120 of the starter strip into the ledger. A deck plank 15 is then placed next to the starter strip. The substantially vertical portion 55 of the deck plank is positioned adjacent to the substantially vertical portion 115 of the starter strip. The space 135 between the angled portion 120 of the starter strip and the angled portion 60 of the tongue allows room for nails which are not flush with the surface of the angled portion 120. This provides a smooth, even fit between the starter strip and the deck plank even if the head of the nail extends upward from the surface of the angled portion 120.

The deck plank is then nailed to the joists 30 along its length. The deck plank is nailed through the angled portion 75 of the groove. A second deck plank may then be placed into position, and the process repeated. The space 110 between the angled portion 75 of the groove of the first deck plank and the angled portion 60 of the tongue of the second deck plank again allows room for the head of nails which may extend upward from the surface of the angled portion 75.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A deck plank comprising:

a generally rectangular plank having a horizontal top and bottom, a first edge attached to the top and the bottom forming a tongue, the tongue having a substantially vertical portion and an angled portion of a first angle, and a second edge opposite the first edge and attached to the top and the bottom forming a groove, the groove having a substantially vertical portion and an angled portion of a second angle, the tongue adapted to fit with a groove of an adjacent plank, the first angle being sufficiently different from the second angle such that the tongue and the groove are adapted to maintain a space between the angled portion of the tongue and the angled portion of the groove of the adjacent plank when the substantially vertical portion of the tongue is placed adjacent to the substantially vertical portion of the groove of the adjacent plank.

2. The deck plank of claim 1 wherein the substantially vertical portion of the tongue has a horizontal slot.

3. The deck plank of claim 1 wherein the tongue has a vertical slit in the substantially vertical portion.

4. A deck plank comprising:

a substantially hollow, generally rectangular plank made from a wood replacement material, the plank having a substantially horizontal top and bottom, a first edge, and a second edge, the first edge attached to the top and the bottom forming a tongue, the second edge opposite the first edge and attached to the top and the bottom forming a groove, the tongue adapted to fit with a groove of an adjacent plank, the tongue having a substantially vertical portion and an angled portion of a first angle, the groove having a substantially vertical portion and an angled portion of a second angle, the first angle being sufficiently different from the second angle such that the tongue and the groove are adapted to maintain a space between the angled portion of the tongue and the angled portion of the groove of the adjacent plank when the substantially vertical portion of the tongue is placed adjacent to the substantially vertical portion of the groove of the adjacent plank.

5. The deck plank of claim 4 wherein the first angle is greater than the second angle.

6. The deck plank of claim 4 wherein the first angle is less than the second angle.

7. The deck plank of claim 4 further comprising at least one vertical support extending from the bottom of the plank to the top at a point intermediate between the first and second edges.

8. The deck plank of claim 4 wherein the top has at least one notch extending the length of the plank.

9. The deck plank of claim 4 wherein the deck plank is extruded.

10. The deck plank of claim 4 wherein the substantially vertical portion of the tongue has a horizontal slot.

11. The deck plank of claim 4 wherein the tongue has a vertical slit in the substantially vertical portion.

12. The deck plank of claim 4 wherein the wood replacement material comprises a polymer.

13. The deck plank of claim 12 wherein the wood replacement material further comprises cellulose material.

14. The deck plank of claim 13 wherein the cellulose material is wood flour.

15. The deck plank of claim 12 wherein the polymer is selected from homopolymers and copolymers of polyethylene and homopolymers and copolymers of polyvinyl chloride and mixtures thereof.

16. The deck plank of claim 15 wherein the wood replacement material further comprises a cellulose material.

17. The deck plank of claim 16 wherein the cellulose material is wood flour.

18. The deck plank of claim 4 wherein the tongue has an upper portion above the substantially vertical portion and the groove has an upper portion above the substantially vertical portion, the upper portion of the tongue and the upper portion of the groove being adapted to maintain a gap between the upper portion of the tongue and the upper portion of the groove of the adjacent plank when the substantially vertical portion of the tongue is placed adjacent to the substantially vertical portion of the groove of the adjacent plank.

19. The deck plank of claim 18 further comprising at least one vertical support extending from the bottom of the plank to the top at a point intermediate between the first and second edges.

20. The deck plank of claim 18 wherein the top has at least one notch extending the length of the plank.

21. The deck plank of claim 18 wherein the deck plank is extruded.

22. The deck plank of claim 18 wherein the tongue has a vertical slit.

23. The deck plank of claim 18 wherein the wood replacement material comprises polymer.

24. The deck plank of claim 23 wherein the wood replacement material further comprises cellulose material.

25. The deck plank of claim 24 wherein the cellulose material is wood flour.

26. The deck plank of claim 23 wherein the polymer is selected from homopolymers and copolymers of polyethylene and homopolymers and copolymers of polyvinyl chloride and mixtures thereof.

27. The deck plank of claim 26 wherein the wood replacement material further comprises a cellulose material.

28. The deck plank of claim 27 wherein the cellulose material is wood flour.

29. A deck comprising:

a support; and at least one deck plank made from a wood replacement material attached to the support, the deck plank being substantially hollow and generally rectangular and having a substantially horizontal top and bottom, a first edge, and a second edge, the first edge attached to the top and the bottom forming a tongue, the second edge opposite the first edge and attached to the top and the bottom forming a groove, the tongue adapted to fit with a groove of an adjacent plank, the tongue having a substantially vertical portion and an angled portion of a first angle, the groove having a substantially vertical portion and an angled portion of a second angle, the first angle being sufficiently different from the second angle such that the tongue and the groove are adapted to maintain a space between the angled portion of the tongue and the angled portion of the groove of the adjacent plank when the substantially vertical portion of the tongue is placed adjacent to the substantially vertical portion of the groove of the adjacent plank.

30. The deck of claim 29 wherein the at least one deck plank further comprises at least one vertical support extending from the bottom of the plank to the top at a point intermediate between the first and second edges.

31. The deck of claim 29 wherein the top of the at least one deck plank has at least one notch extending the length of the plank.

32. The deck of claim 29 wherein the second angle is greater than the first angle.

33. The deck of claim 29 wherein the second angle is less than the first angle.

34. The deck of claim 29 wherein the substantially vertical portion of the tongue has a horizontal slot.

35. The deck of claim 29 wherein the substantially vertical portion of the tongue has a vertical slit.

36. The deck of claim 29 wherein the tongue of the at least one deck plank has an upper portion above the substantially vertical portion and the groove of the at least one deck plank has an upper portion above the substantially vertical portion, the upper portion of the tongue and the upper portion of the groove being adapted to maintain a gap between the upper portion of the tongue and the upper portion of the groove of the adjacent plank when the substantially vertical portion of the tongue is placed adjacent to the substantially vertical portion of the groove of the adjacent plank.

37. The deck of claim 36 wherein the substantially vertical portion of the tongue has a vertical slit.

38. The deck of claim 29 wherein the wood replacement material comprises a polymer.

39. The deck of claim 38 wherein the wood replacement material further comprises cellulose material.

40. The deck of claim 39 wherein the cellulose material is wood flour.

41. The deck of claim 38 wherein the polymer is selected from homopolymers and copolymers of polyethylene and homopolymers and copolymers of polyvinyl chloride and mixtures thereof.

42. The deck of claim 41 wherein the wood replacement material further comprises a cellulose material.

43. The deck of claim 42 wherein the cellulose material is wood flour.

44. The deck of claim 29 further comprising a starter strip made from a wood replacement material attached to the support, the starter strip having a first edge forming a groove adapted to receive the tongue of the deck plank.

45. The deck of claim 44 wherein the tongue of the deck plank and the groove of the starter strip are shaped so that a space is maintained between a portion of the tongue of the deck plank and a portion of the groove of the starter strip when the tongue of the deck plank is placed adjacent to the groove of the starter strip.

46. The deck of claim 44 wherein the groove of the starter strip has a substantially vertical portion and an angled portion of a third angle, the first angle being sufficiently different from the third angle so that a space is maintained between the angled portion of the tongue and the angled portion of the groove of the starter strip when the substantially vertical portion of the tongue is placed adjacent the substantially vertical portion of the groove of the starter strip.

47. The deck of claim 46 wherein the third angle is greater than the first angle.

48. The deck of claim 46 wherein the third angle is less than the first angle.

49. A method of making a deck comprising:

providing a support;

providing a first deck plank made from a wood replacement material, the first deck plank being substantially hollow and generally rectangular and having a substantially horizontal top and bottom, a first edge, and a second edge, the first edge attached to the top and bottom forming a tongue, the second edge opposite the first edge and attached to the top and bottom forming a groove, the tongue adapted to fit with a groove of an adjacent substantially similar plank, the tongue having a substantially vertical portion and an angled portion of a first angle, the groove having a substantially vertical portion and an angled portion of a second angle, the first angle being sufficiently different from the second angle such that the tongue and the groove are adapted to maintain a space between the angled portion of the tongue and the angled portion of the groove of the adjacent plank when the substantially vertical portion of the tongue is placed adjacent to the substantially vertical portion of the groove of the adjacent plank; and attaching the first deck plank to the support.

50. The method of claim 49 wherein the tongue has an upper portion above the substantially vertical portion and wherein the groove has an upper portion above the substantially vertical portion, the upper portion of the tongue and the upper portion of the groove being adapted to maintain a gap between the upper portion of the tongue and the upper portion of the groove of the adjacent plank when the substantially vertical portion of the tongue is placed adjacent to the substantially vertical portion of the groove of the adjacent plank.

51. The method of claim 49 further comprising providing a starter strip having a first edge forming a groove adapted to receive the tongue of the first deck plank, attaching the starter strip to the support, and placing the tongue of the first deck plank adjacent the groove of the starter strip.

52. The method of claim 51 wherein the tongue of the first deck plank and the groove of the starter strip are shaped so that a space is maintained between a portion of the tongue of the first deck plank and a portion of the groove of the starter strip when the tongue of the first deck plank is placed adjacent to the groove of the starter strip.

53. The method of claim 51 wherein the tongue has a substantially vertical portion and an angled portion of a first angle and the groove of the starter strip has a substantially vertical portion and an angled portion of a third angle, the first angle of the tongue of the first deck plank being sufficiently different from the third angle so that a space is maintained between the angled portion of the tongue of the first deck plank and the angled portion of the groove of the starter strip when the substantially vertical portion of the tongue of the first deck plank is placed adjacent to the substantially vertical portion of the groove of the starter strip, and wherein the starter strip is attached to the support through the angled portion of the groove of the starter strip.

54. The method of claim 49 further comprising:

providing a second deck plank made from a wood replacement material, the second deck plank being substantially hollow and generally rectangular and having a substantially horizontal top and bottom, a first edge, and a second edge, the first edge attached to the top and bottom forming a tongue, the second edge opposite the first edge and attached to the top and bottom forming a groove, the tongue of the second deck plank adapted to fit with a groove of an adjacent substantially similar plank, the tongue of the second deck plank having a substantially vertical portion and an angled portion of a fourth angle, the groove of the second deck plank having a substantially vertical portion and an angled portion of a fifth angle, the fourth angle of the second deck plank being sufficiently different from the second angle of the first deck plank so that a space is maintained between the angled portion of the tongue of the second deck plank and the angled portion of the groove of the first deck plank when the substantially vertical portion of the tongue of the second deck plank is placed adjacent to the substantially vertical portion of the groove of the first deck plank;

placing the tongue of the second deck plank adjacent the groove of the first deck plank; and attaching the second deck plank to the support.

55. The method of claim 54 wherein the second deck plank is attached to the support through the angled portion of the groove of the second deck plank.

* * * * *

UNITED STATES PATENT AND TRADEMARK OFFICE

CERTIFICATE OF CORRECTION

PATENT NO. : 5,836,128

DATED : Novenber 17, 1998

INVENTOR(S) : A. Anthony Groh and Philip H. Stobart

It is certified that error appears in the above-identified patent and that said Letters Patent is hereby corrected as shown below:

In column 8, line 38, after the word "comprises" please insert -- a --.

Signed and Sealed this

Thirty-first Day of August, 1999

*Attest:*

Q. TODD DICKINSON

*Attesting Officer*

*Acting Commissioner of Patents and Trademarks*